United States Patent [19]

Hendrischk et al.

[11] Patent Number: 4,478,143

[45] Date of Patent: Oct. 23, 1984

[54] PRINTER

[75] Inventors: Wolfgang Hendrischk, Ulm; Gerhard Nolte, Neu-Ulm-Offenhausen, both of Fed. Rep. of Germany

[73] Assignee: Mannesmann AG, Duesseldorf, Fed. Rep. of Germany

[21] Appl. No.: 9,927

[22] Filed: Feb. 5, 1979

[51] Int. Cl.[3] ..... B41J 15/08; B41J 15/16; B41J 13/08

[52] U.S. Cl. ..... 101/93.05; 101/93.07; 101/93.15

[58] Field of Search ..... 101/93.07, 232, 66, 101/93.11, 90, 93.15, 288, 93–93.6, 93.8–93.10, 93.12–93.14; 400/616.3, 621, 625, 614; 83/175; 414/616–616.2, 617

[56] References Cited

U.S. PATENT DOCUMENTS

| | | | |
|---|---|---|---|
| 3,673,905 | 7/1972 | Kone | 83/175 |
| 3,958,270 | 5/1976 | Graniere | 101/93 |
| 4,000,803 | 1/1977 | Warp | 400/616.3 |
| 4,011,811 | 3/1977 | Kodis | 101/93.07 |
| 4,043,440 | 8/1977 | Busch | 400/614 |

*Primary Examiner*—J. Reed Fisher

*Attorney, Agent, or Firm*—Ralf H. Siegemund

[57] ABSTRACT

The printer includes a common feed and eject portion constructed as friction belt drive; it further includes a friction drum and a print head and cutter between the drum and the ejection portion which participates in the advance during printing but runs a little longer than the friction drum to hold the paper taut. This period is extended during advance after printing the last line to tension the paper during cutting. The combination of feed and eject permits front end feeding and ejection.

11 Claims, 6 Drawing Figures

CONTROLLER

PRINTER

BACKGROUND OF THE INVENTION

The present invention relates to a printer which includes means for feeding and advancing a sheet, web, strip, etc.; a print head which can be moved transversely to the web or sheet after advancing; a cutter to separate a short sheet from the strip, web or a long sheet; and an ejection device for the cut off and printed on sheet.

Moreover, printers of the type to which the invention pertains have position sensors and electronic control circuit means to control the operational sequence of feeding, printing, cutting and ejecting, all of these not necessarily in that sequence, though, of course, ejecting is always the last step.

A problem has arisen in known printers of the type referred to above concerning the processing of thin sheets and/or the cutting of short pieces. Moreover, the printer should not occupy too much space and feeding paper should be from the front, the printed on sheet should also arrive in the front.

SUMMARY OF THE INVENTION

It is an object of the present invention to improve printers of the type outlined above and to solve the problem and meet the objectives as stated.

In accordance with the preferred embodiment of the present invention, it is suggested to move the sheet through the printing range and the cutting plane by means of two friction means engaging the sheet and being controlled so that the friction means pertaining to the ejection portion of the printer is stopped after the friction means advancing the sheet to the printing area has been stopped for purposes of subsequent cutting.

The printer as a whole is constructed to include a capstan unit comprised of several friction belts each held by pulleys arranged, e.g. in a triangle, and the portion of each belt as between respective two of the pulleys, defines an ejection path; each belt as engaging another pulley defines a frictional feeder. The sheet advance includes a friction drum receiving a sheet from the feeder, and pressure rollers hold the sheet against the drum which advances it towards the print head and platen area, through a cutting plane and towards engagement with the ejection path belt portions, which, in turn, cooperate with smooth wall rollers. The belt drives stop after the friction drum, just prior to cutting after printing. During printing, drum and belts together advance the sheet in steps, whereby the belts engage the sheets with less friction than the drum, but the belts run a little faster.

The inventive printer makes sure that the sheet is tensioned in the cutting plane just prior to cutting to ensure a clean cut. Also, the sheet portion being cut off is already in the range of the ejection device (belts) and will be ejected promptly and safely. The construction arrangement of the printer ensures a compact design and front feeding and ejection.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DESCRIPTION OF THE PRINTER

Figure 1:
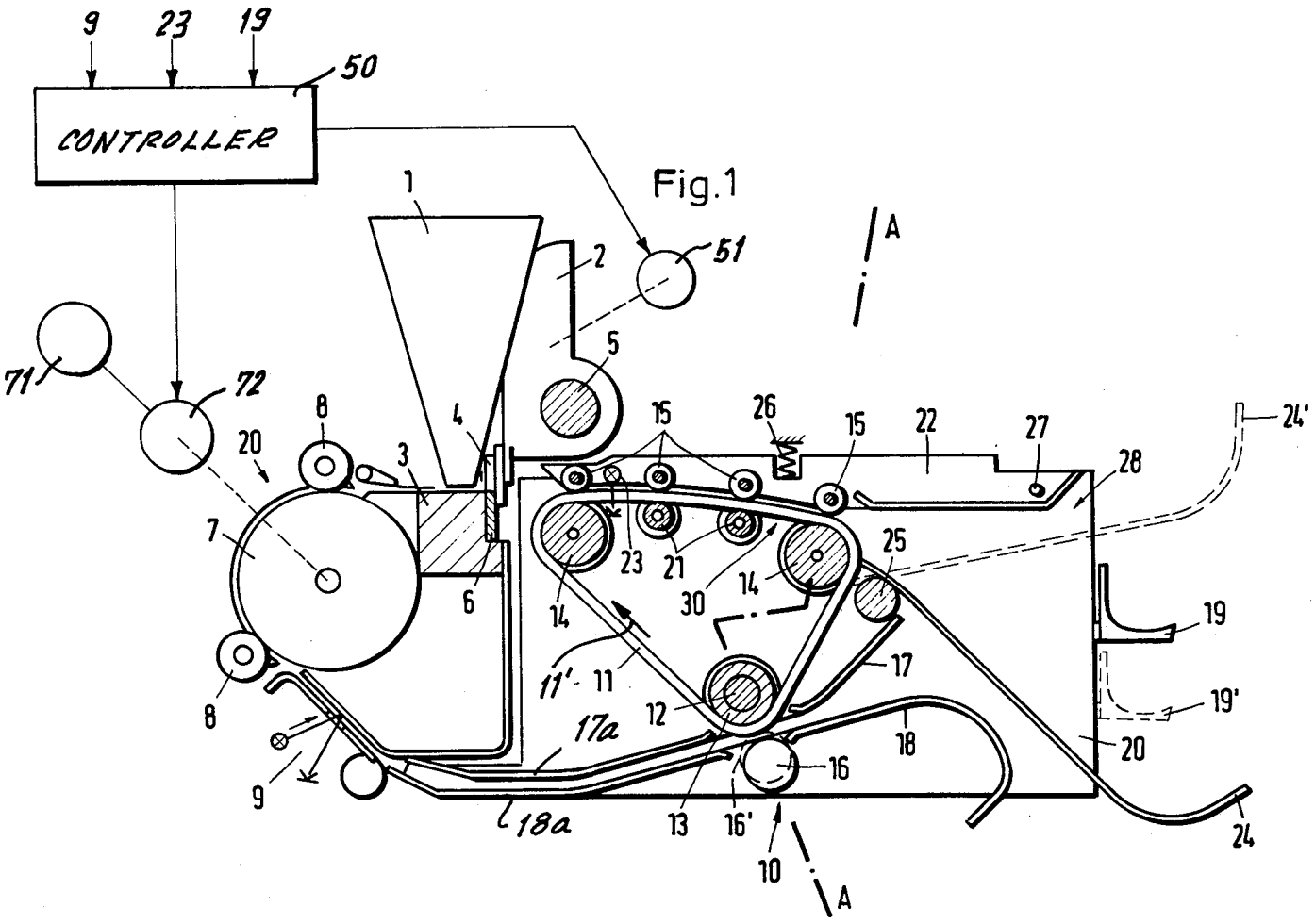
FIG. 1 is a cross-section through a printer in accordance with the preferred embodiment of the invention.

Proceeding now to the detailed description of the drawings, FIG. 1 illustrates a print head of the matrix variety, in which a plurality of print needles are arranged transversely to a print line and are selectively activated for composing characters out of print dots as the head 1 moves across the sheet to be printed on. The head 1 is mounted on a carriage 2 which is moved on a rail 5, transversely to the plane of the drawing of FIG. 1.

Printing is carried out as against a stationary platen 3 carrying also a stationary cutting edge 6. Analogously, carriage 2 carries a cutter 4 which cooperates with edge 6 during the transverse movement of the carriage. The cutter, and particularly roller 4, are shown schematically only, but one can readily use a cutter structure as disclosed in U.S. Pat. No. 4,152,962. The cutter roller pivots in the cutting plane and is normally retracted so that any sheet can be moved through that plane, and the carriage 2 with head 1 can be moved across a sheet and platen without cutting.

Reference numeral 20 denotes the device for advancing paper sheets for placement between print head 1 and platen 3. This device 20 is comprised of a motor driven friction drum or roller 7, cooperating with pressure rolls or capstan rollers 2 arranged along the drum's periphery. The drum 7 in particular advances paper from one print position (printing of a line) to the next one. However, the drum 7 participates also in the initial feed.

The drive 71 for drum 7 is denoted only schematically, so is the carriage drive 51. Drive motor 71 runs continuously, but a controllable clutch 72 is interposed between the drum 7 and the drive 71. The clutch 72 as well as the drive 51 are controlled by a controller 50. This controller 50 has several inputs, one of them being a light barrier or light source and detector arrangement 9. This detector arrangement is disposed upstream of friction roller 7 and searches for perforations or other distinctive markings on the sheet being advanced towards roller 7. The detector 9 has a particular disposition in relation to the cutting plane. One can say, e.g. that the path length between the location of detector 9 and the cutting plane equals the length of a form or sheet to be cut, so that, indeed, upon detection of a perforation or marking by detector 9, cutter 4 moves properly across the web. The controller 50 also activates the cutter 4 in those instances.

Figure 2:
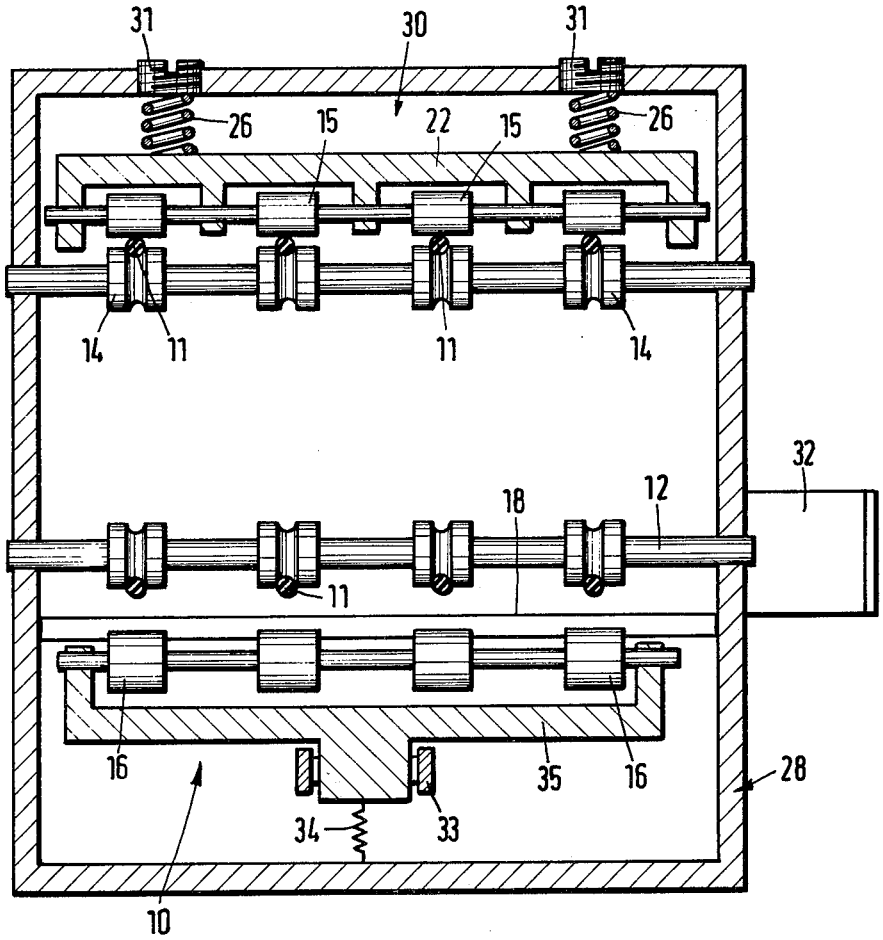
FIG. 2 is a section view as indicated by line A—A in FIG. 1.

The printer includes further a paper feed device 10 and an ejection device 30, and these two devices are structurally integrated in a common housing 28. The two devices share a common capstan constructed as a belt unit. This unit is comprised of four belts (see FIG. 2) being in frictional engagement with drive pulleys 13 on a shaft 12. The shaft 12 is driven by a d.c. motor 32 which is attached to the casing or housing 28. The belts 11 run further over two sets of idler pulleys 14 (two pulleys per belt). It can thus be seen that two pulleys 14 and one pulley 13 run and drive one of the belts and these pulleys are disposed to impart upon the belt approximately a triangular configuration. One side of that triangle pertains to the ejection device 10 and ejection path while the corner or apex of the triangle opposite that side pertains to the feeder 10. Due to the fact that there are four belts, this triangular configuration is repeated in four planes and in geometrically matching patterns.

As far as the feeder is concerned, it includes additionally smooth wall pressure rollers 16 seated on a common shaft which is journalled on a mounting bar 35. That bar is biased by a spring 34 in down direction so that the individual rollers 16 will not engage normally a belt nor clamp a sheet in-between.

Guide sheets 17 and 18 leading towards the gap and space between the pulleys 13 and rollers 16 provide an entrance chute or slot for paper, a web, etc. Reference numerals 17*a* and 18*a* refer to continuation sheets downstream from the pulleys 13 and rollers 16, defining a feeder channel for running the sheet or web towards friction roller 7 of the advance device 20.

The bar 35 is pivotally linked to transverse bars 33 which, in turn, connect to an externally accessible lever 19. This arrangement 33–19 acts as two arm lever. In the solid drawn position of FIG. 1, lever 19 is up and the rollers 16 on bar 35 are retracted by operation of the spring 34, i.e. they do not engage or tend to engage the belts 11. Upon pressing lever 19 down (dashed position) and holding it down, the rollers 16 are moved up and any paper between rollers 16 and belts 11 will now be clamped in-between and forced to follow the movement of the belts (arrow 11'), but into the chute 17*a*–18*a*.

As far as the ejection device 30 is concerned, it includes pressure rollers 15 on a holder 22 which is pivoted on housing 28 by means of pins such as 27. Springs 26 bias the holder 22 in down direction so that the rollers 15 may engage the belts 11 or clamp any sheet against them. The force of the springs 26 is adjustable by means of screws 31. Rollers 15 are also of smooth wall, cylindrical configuration.

FIG. 1 shows that two sets of rollers 15 are, respectively, disposed adjacent to pulleys 14. Two other sets of rollers 15 cooperate with idler pulleys 21, whereby two such pulleys are disposed along the path of each belt, the ejection path extending from one of the reversing pulleys 14 to another one of the second set. It should be noted that springs 26 may not be needed, as the weight of the arm 22 may suffice to urge the rollers 15 against the friction belts 11 for clamping action. It should be noted further that the ejection device 30 is always operative whenever the motor 32 drives the belts.

A light barrier with detector 23 is disposed, so to speak, inside of the ejection device. As the front end of a sheet interrupts that barrier, the sheet has been gripped already by that portion of the ejection device which faces the cutting plane and printing area. The output of detector 23 is another input for the controller 50.

OPERATION

The printer will be operated in four modes, feeding, printing, cutting, ejection. Feeding begins by folding up the ejection tray 24 into position 24', and a sheet or web of paper is now pushed, e.g. manually between the entrance sheets 17 and 18, and sufficiently far so that the front edge is placed beyond feeder 10. One may feed an individual sheet in that manner, but alternatively, a roll of paper may be suitable positioned, and the front end of that roll is fed into the entrance slot 17–18.

Next, lever 19 is pushed down and the belt drive motor 32 is started by a push button or by a switch that is combined with and activated by lever 19. Also, motor 71, and/or cluth 72 is pulled in and begins to run. The switching operation performed by lever 19 for controller 50 may be of the pushbutton type so that upon subsequent release of the lever 19, motion is not stopped therewith.

The two motors 32 and 71, and the respective transmission, are designed and/or controlled so that the linear transport speed of the belts 11 and the peripheral speed of friction drum 7 are at least approximately equal. One can also say that during the feeder mode device 20 is part of the feeder device. Moreover, once the paper has been gripped by device 20, lever 19 should be released so that the belts 11 no longer participate in the paper feeding, device 20 feeds alone.

The feeding is completed after the front edge of the paper has passed across detector 23 which is downstream from the first set of ejection rollers 15. A second condition for stopping feeding is the detection of a perforation by detector 9. Based on these conditions, motor 32 stops and clutch 72 is releaved to stop the drum 7. As stated, detection of a perforation initiates a cutting operation, and the front portion of the sheet, downstream from the cutting plane, is cut off. In other words, the controller 50 stops the paper drives but activates the carriage drive 51 and also causes the cutter 4 to be lowered into the illustrated position, the normal position of the cutter 4 is up so that paper can pass. After the carriage 2 has moved across the strip in cutting operation, motor 32 is restarted and the cut off portion of the strip is reeled out of the printer by the ejection device.

PRINTING

The printing operation is carried out in conventional manner as far as the operation of the printing needles in head 1 is concerned. Also, printing is controlled by the controller 50 in stop and go fashion as an alternation of carriage moving and paper advance cycles. In a carriage move and print cycle motor 51 moves the carriage 2 across, the cutter being retracted. It is optional whether the printer is designed to print forward and backward, i.e. in both directions of carriage movement or whether one retracts the carriage before or after each line print step. After printing one line in that fashion, the motor 31 is restarted and clutch 72 is pulled in to move the paper by a particular space equal to the desired line spacing. Drum 7 and belts 11 stop again and another print cycle follows, etc. The controller 50 controls the advance of the sheet from line to line in accordance with a print program that may demand different spacings between some of the lines. It is, however, important to realize that the ejection device participates in the sheet advance.

It is an important feature of the printer that the force exerted by all the pressure rollers 15 upon the paper is less than the frictional engagement of the sheet by drum 7 by means of rollers 8. Moreover, motor 32 will always run a little faster and longer than clutch driven drum 7 so that the paper is tensioned and pulled taut, but rather gently. This is particularly advantageous when the sheet is rather wide and the portion to be cut fairly short. These aspects will become more fully apparent with reference to FIGS. 3 to 6.

Figure 3:
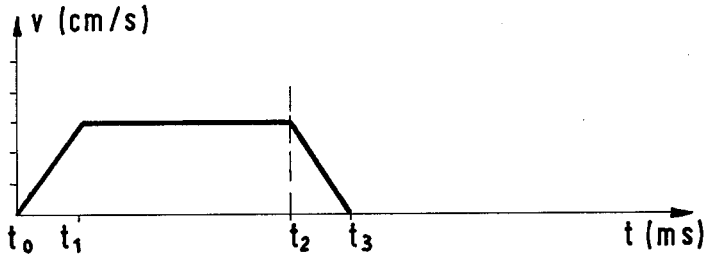
FIGS. 3 through 6 are speed vs. time diagrams representing different cases and phases of paper advance and ejection in the printer.
Figure 4:
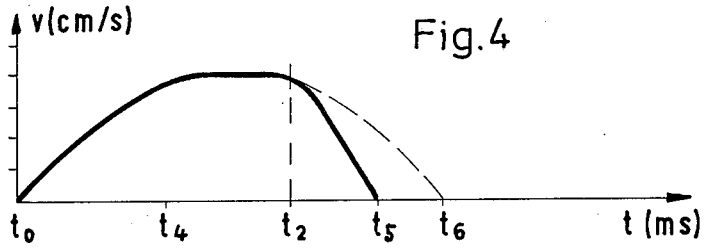

FIG. 3 illustrates the velocity profile of the paper as advanced by drum 7 in-between two print steps. Beginning at a time $t_0$ the drum accelerates to paper feed and advance speed (time $t_1$), moves at that speed and is de-energized or even braked at time $t_2$ to stop at $t_3$. Concurrently thereto ($t_0$) motor 32 is energized (FIG. 4) but accelerates at a lower rate. Thus, as drum 7 reaches the rated paper advance speed at time $t_1$, motor 32 and particularly belts 11 have not yet reached that speed; motor 32 reaches maximum speed at a later time, namely about $t_4$, but that speed is higher than the speed of drum 7. Thus, there is a certain slippage between the sheet and the belts 11. At time $t_2$ motor 32 and clutch 72 are de-energized. Motor 32 by itself would run down along the dashed characteristics to stop rather late, at time $t_6$. However, the drum 7 stops at a faster rate and holds the paper back. Thus, the sheet portion between advance 20 and ejection 30 is taut and adds to the load on motor 32 which accordingly is slowed down faster and stops at earlier time $t_5$, which is just a little after $t_3$.

It can thus be seen that the sheet is always held taut for the printing step that follows each advance step. Using here primarily the differences in speed and in the slowdown characteristics of the drum and of the ejection motor 32 suffice indeed. Nevertheless, one must realize that these periods, such as $t_2$–$t_3$ are quite short, such as about 10 milliseconds. Thus, it is advisable to tension the paper a little more for the final cut off, following the last printing by means of active control rather than by passive cooperation during slow-down or current turn-off.

Figure 5:
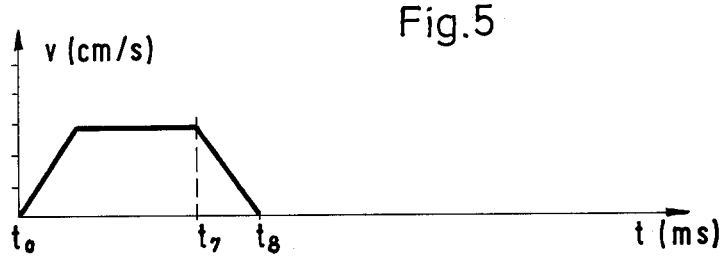
Figure 6:
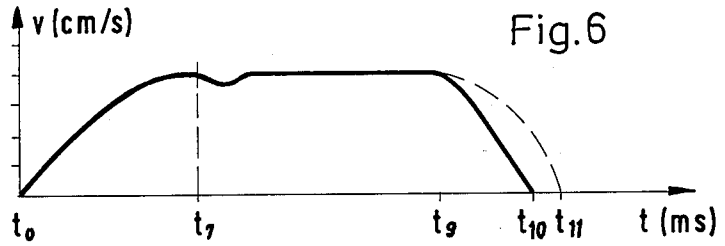

FIG. 5 illustrates the last advance step which follows printing of the last line, and one can see that this advance step is cut short because just prior to $t_7$ detector 9 detected a perforation so that the drum 7 is stopped right at that point, its velocity profile runs down and reaches zero at time $t_8$. Of course, a longer-than-normal advance step could follow the last line printing, depending on the format, print program, etc. Now, in this last advance step, motor 32 is not yet turned off. In other words, the control from unit 50 separates the control following the last line printing and just pulls clutch 72 when detector 9 detects a marking, perforation, etc.

Following time $t_7$, the motor 32 experiences a short slowdown (FIG. 6) but recovers and is turned off by the controller 50 at time $t_9$, which is about 50 milliseconds after $t_7$. During this period $t_7$–$t_9$, the paper is tensioned tightly and stretched to be taut across the cutting plane. Motor 32 is de-energized at $t_9$. Without paper load, it would reach zero at $t_{11}$, but the added load causes faster deceleration and the motor actually stops at $t_{10}$.

Cutting and ejecting. After drive 32 of ejection device 30 has come to a stop (time $t_{10}$), the sheet is tensioned but not subjected to progressive tension. Now the control device 50 triggers cutting by causing again the carriage 2 to move across the sheet. Moreover, the cutter 4 is lowered to obtain cutting. After the carriage 2 has traversed the width of the sheet and cutting has been completed, the motor 32 is restarted to eject the cut off portion into the tray 24.

It should be noted that motor 32 runs in approximate synchronism with drum 7 only in the initial feeder mode, i.e. in response to push down by lever 19, up until response by detector 23. Thereafter, motor 32 is controlled to run a little faster. When in the eject mode, after cutting, it makes no difference whether the motor 32 runs at a speed as in the feed mode or faster as during the print-and-advance cycles.

The invention is not limited to the embodiments described above but all changes and modifications thereof not constituting departures from the spirit and scope of the invention are intended to be included.

We claim:

1. A printer for printing on a sheet and including feeding and advancing means acting on the sheet for placing it in the range of a transversely movable printing head, cooperating with a platen, there being a cutter disposed downstream from the printing head and an ejection device downstream from the cutter, the advancing means including motor drive and first friction drive means subject to stop and go control, the improvement comprising:

the ejection device including second friction-driven means arranged downstream from the cutter for engagement of a side of the sheet that faces the platen, further including spring-biased, smooth-surface idler roller means disposed adjacent to the second friction drive means, also downstream from the cutter, and facing a side of the sheet that faces the head; and control means for controlling the first and second friction drive means, so that, just prior to cutting, the second friction drive means of the ejection device stops after the first friction drive means of the advancing means has stopped.

2. A printer as in claim 1, wherein said second friction drive means is arranged along a direction of ejection, the idler roller means being correspondingly arranged in plural sets of rollers.

3. A printer as in claim 1, said second friction drive means further constructed, so that a portion is placed adjacent to a feeder path for a sheet, ahead of and upstream from the first friction means, and further including selective, operable pressure roller means for causing a sheet to engage the second friction means for feeding it to the first friction means.

4. A printer as in claim 1 or 3, wherein the second friction means includes plural drive belts, a portion of each drive and all belts defining a frictional engagement transport path for the sheet in the ejection device.

5. A printer as in claim 3, said second friction drive means being comprised of plural parallel running belts, three pulleys for each belt, and deflecting the belts to assume an approximately triangular configuration, paths of the belts between two of the pulleys defining an ejection path, idler rollers being disposed adjacent to the two pulleys, the selectively operable pressure roller means being disposed adjacent to the respective third one of the three pulleys.

6. A printer as in claim 1, including light detector means disposed to respond to arrival of a front edge of the sheet in a range of the ejection device to control stopping of the first friction drive means.

7. A printer as in claim 1, and including detection means particularly positioned in relation to the cutting plane and connected to the control means to stop the first and second friction drive means and to operate the cutter.

8. A printer as in claim 1, said idler roller means being disposed on a spring-mounted lever.

9. A printer, comprising:

a plurality of friction belts arranged parallel to each other, each of the endless belts being trained about three pulleys arranged in a triangle, so that the pulleys assume a substantially triangular configuration, said pulleys defining accordingly corners of the triangles, one run of each belt extending between respective two of said pulleys, defining and establishing an ejection path, each belt being looped partially around a third one of the pulleys, the respective third pulley being located accordingly opposite said one run, there being a plurality of third pulleys accordingly, one for each of said belts, said third pulleys together with the respective looped belts defining a portion of a feeder path;

a friction drum disposed in relation to said friction belts, for being in part enveloped by a sheet as it was advanced by the belts at said portion of a feeder path, and advancing the sheet toward said ejection path;

a print head and platen disposed between said drum and said belts in the ejection path;

plural pressure roller means disposed for cooperating with the belts, respectively adjacent to said third pulleys, and adjacent to said ejection path, for respectively clamping a sheet or web in between;

a cutter disposed between the platen and the ejection path; and means for selectively driving the belts and the drum so that the sheet is taut between the drum and the ejection path.

10. A printer as in claim 9, said drive means causing the drum to stop ahead of the belts prior to cutting by the cutter.

11. A printer as in claim 1, 6 or 9, including a detector disposed upstream from the cutter at a particular distance therefrom, for controlling the cutter thereof as well as the timing of cutting.

* * * * *